United States Patent [19]

Lautenschläger, Jr.

[11] Patent Number: 4,653,937

[45] Date of Patent: Mar. 31, 1987

[54] DRAWER GUIDE

[75] Inventor: Karl Lautenschläger, Jr., Reinheim, Fed. Rep. of Germany

[73] Assignee: Karl Lautenschläger KG, Möbelbeschlagfabrik, Reinheim, Fed. Rep. of Germany

[21] Appl. No.: 829,786

[22] Filed: Feb. 14, 1986

[30] Foreign Application Priority Data

Feb. 19, 1985 [DE] Fed. Rep. of Germany ..... 3505614

[51] Int. Cl.[4] ..... F16C 25/06

[52] U.S. Cl. ..... 384/19; 384/57

[58] Field of Search ..... 384/19, 57, 17, 22, 384/20, 58

[56] References Cited

U.S. PATENT DOCUMENTS 3,366,426 1/1968 Krans ..... 384/57
3,504,952 4/1970 Farmer ..... 384/57
3,874,748 4/1975 Figueroa ..... 384/19
4,199,200 4/1980 Livingston ..... 384/19

*Primary Examiner*—Lenard A. Footland

[57] ABSTRACT

On a guide for drawers and other such furniture parts, having a guide rail which can be fastened to the wall of a cabinet, and a runner rail which can be fastened to the drawer, these rails being displaceable relative to one another by means of at least one wheel mounted on the front end of the guide rail and at least one wheel mounted on the rear end of the runner rail, an approximately rectangular adjuster is disposed on the front end of the guide rail in contact with the runner rail and is held displaceably and removably on the vertical web of the guide rail. The adjuster has on its side facing the flange of the runner rail a ramp surface which, by the displacement of the adjuster, can be brought to bear against the confronting edge of the runner flange.

11 Claims, 10 Drawing Figures

DRAWER GUIDE

BACKGROUND OF THE INVENTION

The invention relates to a guide for drawers and other such furniture parts, having a guide rail in the form of a track which can be fastened to the wall of a cabinet carcase, and a runner rail which can be fastened to the drawer, these rails being displaceable relative to one another on at least one roller rotatably mounted on the drawer-front end of the guide rail, and at least one roller rotatably mounted on the rearward end of the runner rail, each roller rolling on a flange of the other rail, while a displaceable adjusting element engaging the runner rail is disposed on the guide rail and permits the adjustment of the transverse free play of an associated drawer.

Drawer guides of this kind have become increasingly widely used in modern furniture, especially when used in pairs on opposite sides of drawers, slides, pull-out work surfaces, appliance carriers and the like, on account of the lesser effort involved in their use in comparison with sliding drawer guides. In the manufacture of furniture, inaccuracies constantly occur in the width of the drawers and in the open width between the walls of the carcase. These inaccuracies do not adversely affect the operation of the drawers, because the lateral shifting of the rollers resulting therefrom on the associated track flanges is possible, but so is lateral movement of the drawer across the direction of drawer movement, so that, for example, the vertical edges of the drawer fronts of several drawers arranged one over the other are no longer in precise alignment, resulting in an unsightly appearance. Moreover, the lateral guidance of the drawer is impaired increasingly as the drawer is pulled further out. A drawer drawn all the way out can then have considerable cross-play at the drawer front, even though the actual cross-play between the guide rail and the runner rail is relatively slight. To remedy this cross-play, it is known to dispose an adjusting element on one of the rails, preferably on the guide rail which is affixed to the furniture wall, thus permitting adjustment of the cross-play. In a known drawer guide adjustable for cross-play (DE-OS No. 31 09 021) the adjusting element is, for example, in the form of a sector which is mounted on the pivot of the roller on the front end of the guide rail so as to be rotatable by a given angular amount of about 90° and which has in its portion projecting beyond the wheel circumference a margin of varying thickness. By turning the sector, marginal portions of different thickness can be brought opposite the edge of the runner rail flange that runs on the guide-rail roller, thus compensating for any play that might develop. The play adjustment with this sector has proven useful, yet the sector has to be placed on the pivot of the wheel at the time when the guide rail is installed. The retrofitting of the sector, or the removal of one previously installed is not possible without destroying it, because the wheel confronting the sector is permanently riveted on the pivot, i.e., it is not removable. This means, however, that the known drawer guide is provided with the adjusting element in every case, regardless of whether any adjustment is or is not necessary in the case of the piece of furniture on which it is later installed.

Accordingly, it is the object of the invention to create a drawer guide having a cross-play adjustment that is just as effective, but in which the adjusting element can be installed on or removed from the installed guide rail for the purpose of enabling the same drawer guide to be used either as a nonadjustable or as an adjustable guide. At the same time, it is to be possible to convert it from the one to the other type of drawer guide.

SUMMARY OF THE INVENTION

Setting out from a drawer guide of the kind mentioned above, this object is achieved according to the invention in that the adjusting element is an adjusting body which is mounted on the front end of the guide rail on its vertical web surface facing the runner rail, for displacement and removal at right angles to the length of the guide rail, and which has a ramp sloping in the adjusting direction on its side facing the flange of the runner rail which runs on the roller mounted on the guide rail. The compensation of free play is therefore accomplished by the upward and downward displacement of the adjusting body such that the ramp engages the free edge of the runner rail flange without free play.

The adjusting body is best disposed within an interstice existing between the web surface of the guide rail and the roller rotatably mounted on a pivot projecting from the web surface at the front end of the guide rail, while the adjusting body can best be in the form of an approximately rectangular body having a slot running in the direction of adjustment but having an opening at one end for the entry of the pivot.

To facilitate the displacement of the adjusting body when making an adjustment for free play, the configuration is preferably made such that the adjusting body projects out of the interstice between the wheel and the web surface of the guide rail toward the front end of the guide rail, and that a thumb hold facilitating displacement of the adjusting body is provided on this projecting section.

To assure the precise guidance of the adjusting body in the intended direction of adjustment, it is recommended to provide the adjusting body on its side facing the web surface of the guide rail with a groove running in the direction of adjustment, which will be engaged by a narrow flange projecting from the guide rail. The double guidance of the adjusting body in the groove on the one hand and the slot guided on the pivot on the other hand, assures precise guidance in the intended direction of displacement. Any unintentional backing of the adjusting body away from the guide rail is prevented by its arrangement in the interstice between the web surface of the guide rail and the guide wheel.

At the same time the configuration is best made such that the adjusting body extends to approximately the front vertical edge of the guide rail, and that a narrow section of the end marginal area extending over only part of the height of the vertical edge is bent outwardly to form the flange engaging the adjusting body groove.

On the adjusting body and the guide rail it is furthermore desirable to provide abutments which, when the adjusting body is shifted, will engage one another before the pivot escapes from the open end of the slot, so as to prevent unintentional separation of the adjusting body from the guide rail.

The abutment on the guide rail in that case can be formed from the horizontal edge of the section of its margin which remains unbent after the forming of the flange; this abutment will then cooperate with a projection protruding from the back of the adjusting body facing the web surface of the guide rail, which constitutes the corresponding abutment on the adjusting body. To permit the adjusting body to be removed in spite of the cooperating abutments, it is necessary only to lift the abutment on the adjusting body away from the one on the guide rail, which will require but a slight resilient flexing of the adjusting body, since the abutment on the guide rail is of a thickness corresponding only to the thickness of the material of the guide rail.

To provide the necessary elastic flexibility of the adjusting body and manufacture it simply and cheaply, the adjusting body can be manufactured from thermoplastic, preferably by the injection molding method.

BRIEF DESCRIPTION OF THE DRAWING

The invention will be further explained in the description that follows of an embodiment, in conjunction with the drawing, wherein.

DETAILED DESCRIPTION OF PREFERRED EMBODIMENTS

Figure 1:
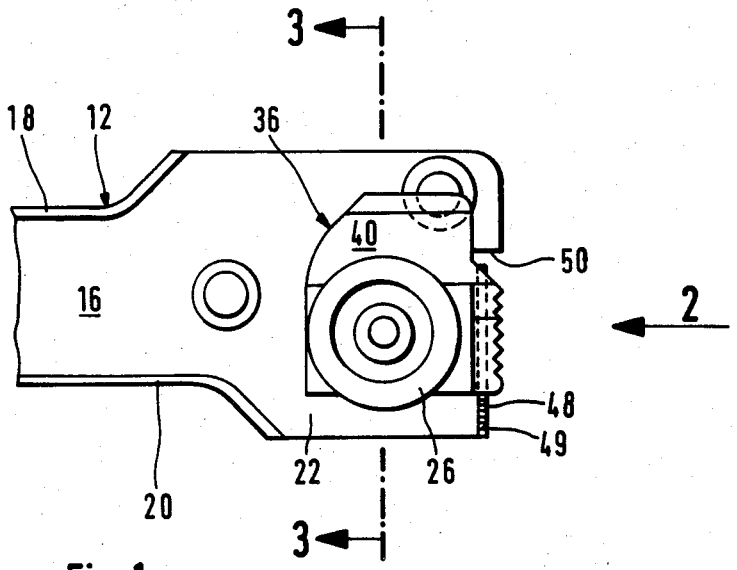
FIG. 1 shows an elevation of the front end portion of a guide rail of a drawer guide according to the invention, which is provided with an adjusting means for compensating cross-play.
Figure 3:
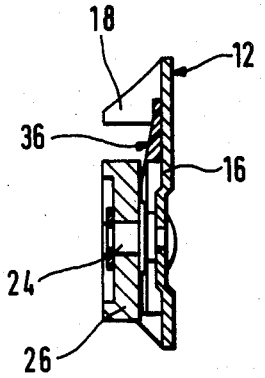
FIG. 3 is a cross sectional view as seen in the direction of the arrows 3—3 in FIG. 1.
Figure 2:
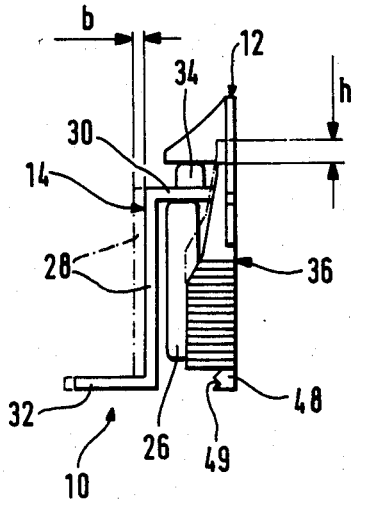
FIG. 2 is an elevation of the drawer guide as seen in the direction of the arrow 2 in FIG. 1.
Figure 4:
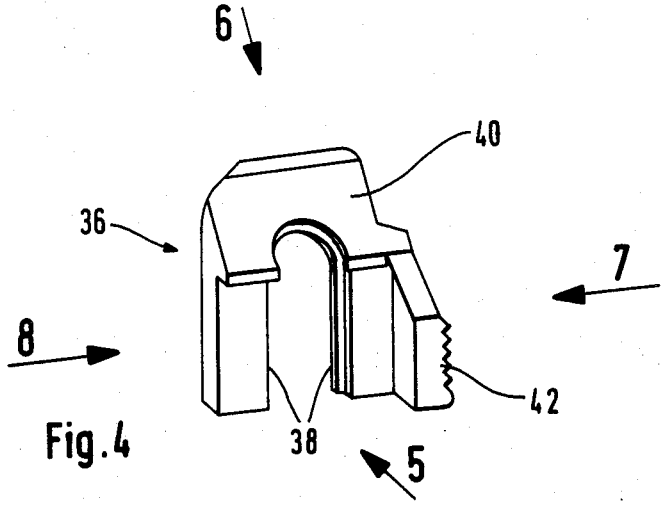
FIG. 4 is a perspective view of the adjusting element.
Figure 5:
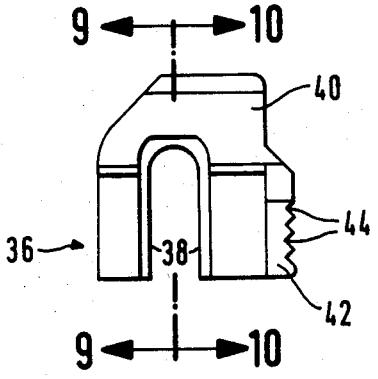
FIG. 5 is a front elevation of the adjusting element as seen in the direction of the arrow 5 in FIG. 4.
Figure 6:
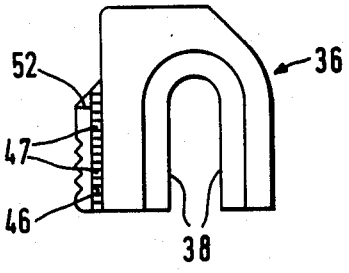
FIG. 6 is a rear view of the adjusting element, as seen in the direction of the arrow 6 in FIG. 4.
Figure 7:
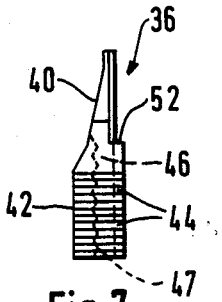
FIG. 7 is a side elevational view of the adjusting element, as seen in the direction of the arrow 7 in FIG. 4.
Figure 8:
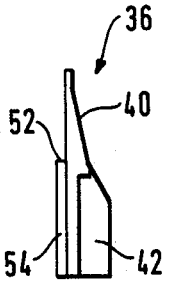
FIG. 8 is a side elevational view of the opposite side of the adjusting element, as seen in the direction of the arrow 8 in FIG. 4.
Figure 9:
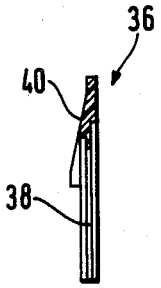
FIG. 9 is a cross-sectional view of the adjusting element taken along the arrows 9—9 in FIG. 5.
Figure 10:
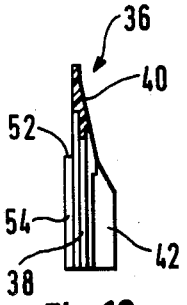
FIG. 10 is a cross-sectional view of the adjusting element in the plane indicated by the arrows 10—10 in FIG. 5.

The drawer guide 10 according to the invention is formed by the guide rail 12 whose front end portion is shown in FIGS. 1 to 3 and is to be fastened to the supporting wall of a cabinet carcase, and the runner rail 14, shown only in FIG. 2, which can be fastened to the drawer—to the side of the drawer for example—, it being clear that corresponding rails of a mirror-image configuration must also be provided on the other supporting wall and drawer side. The guide rail 12 is of a channel-like cross section having a web 16, which can be screwed to the supporting wall, and two flanges 18 and 20 bent at right angles from the web. At the forward end area represented in FIG. 1, the surface of web 16 is converted to an enlarged, flangeless flat portion 22 into which a pivot 24 projecting toward the associated runner rail is riveted, on which a roller 26 is rotatably mounted.

The runner rail 14, which can be fastened to the drawer, is likewise in the form of an elongated channel having two flanges 30 and 32 also bent at right angles, but in this case in opposite directions, of which the underside of the upper flange 30 bent toward the guide rail 12 runs on the roller 26, while the lower flange bent away from the guide rail reaches under the drawable cabinet part, e.g., the bottom edge of a drawer side, with the web 28 placed against its lateral surface. On the rearward end, i.e., the end inside of the cabinet, of the runner rail 14 there is also riveted a pivot (not shown) on which a roller 34 (FIG. 2) is rotatably mounted, whose diameter is selected such that it fits precisely between the flanges 18 and 20 of the guide rail 12 and thus can roll on the confronting surfaces of these flanges. To this extent, the draw guide 10 corresponds to known drawer guides, so that it need not be further described in detail.

What is novel, and essential to the desired possibility for the adjustment of the transverse free play of a drawer in a cabinet carcass, is the adjusting body 36 shown separately in FIGS. 4 to 10, which is disposed on the front end of the guide rail 12, substantially in the interstice between the flat portion 22 and the roller 26 mounted on the pivot 24. The adjusting body is basically in the form of an approximately rectangular body in the illustrated case, having a linear perpendicular slot 38 that is open at its bottom edge and whose width is such that it fits over the section of the pivot pin 24 that is in the gap between the roller and the flat portion 22. The adjusting body 36 is therefore displaceable on the flat portion 22 in the direction of the slot 38, i.e., in the vertical direction. On its side facing the roller 26, it is provided in the upper portion with a ramp 40 which rises—with respect to a vertical section plane—from the upper horizontal margin downwardly at an angle to the roller 26. I.e., the thickness of the upper portion of the adjusting body provided with the ramp surface 40 increases constantly from its upper horizontal margin. By the displacement of the adjusting body 36, this ramp can be brought into engagement with the front free edge of the flange 30 of the runner rail 14 running on the roller 26, so that any lateral free play can be completely compensated.

In addition to the position of the adjusting body 36 represented in FIG. 2 the adjusting body 36 is represented in broken lines also in a position in which it is raised by the amount h, and it can be seen that in this case the position of the runner rail 14 is positively displaced horizontally by the amount b, because the ramp surface 40 of the adjusting body, which engages the edge of the flange 30, displaces the runner rail 14 to this position by a wedging action. Conversely, then, any gap existing between the edge of the flange 30 of the runner rail 14 and the confronting ramp surface 40 can be compensated by shifting the adjusting body 36 upwardly.

The adjusting body 36 also overreaches the periphery of the roller 26 on the front facing out of the carcase, and in the portion situated in front of the circumference of the roller 26 there is formed a thumb hold 42 projecting over the circumferential surface of the roller 26, which is provided with knurling to provide a good grip. In the (planar) bottom of the adjusting body 36 there is formed, in the area behind the thumb hold 42, a narrow groove 46 (FIGS. 6 and 7) which is engaged by a thin flange 48 (FIGS. 1 and 2) which is formed by a narrow section raised at right angles from the margin of the flat portion 22. The bottom surface of the groove 46 is provided with transverse indentations 47 (FIGS. 6 and 7) of triangular cross section, while complementary teeth are formed on the edge of the flange 48 facing the bottom of the groove. The indentations 47 and teeth 49 assure the fixation of a set level of the adjusting body without preventing any readjustment that may become necessary. The flange 48 is bent from only a portion of the width of the flat portion 22, so that, in the upper part of the flat portion 22, there remains an unbent section extending further back by an amount corresponding to the width of the flange 48. The bottom edge 50 (FIG. 1) of this section forms, together with the upper edge 22 of a projection 54 provided on the bottom of the adjusting body near the thumb hold 42, an abutment which limits the travel of the adjusting body 36 in the vertical direction such that the end of travel is reached before the pivot 26 escapes from the open mouth of the slot 38.

The adjusting body 36 is made, in the present case, of a thermoplastic which has a certain elasticity. By the elastic flexing of the adjusting body at its upper edge the abutting surfaces 50 and 52 can be disengaged from one another, and then the adjusting body 36 can be removed upwardly from the gap between the roller 26 and the flat portion 22. The above-described mounting of the adjusting body 36 thus has the advantage that it is normally disposed between the roller 26 and the flat portion 22 so that it can not be lost, but in case of necessity it can be removed at any time or, if there is no adjusting body present, one can be installed without the need for complicated manipulation with tools or the like.

It is apparent that modifications and further developments of the described example can be made within the scope of the invention. For example, the security against unintentional displacement of the adjusting body 36 from a selected position, which is provided by the indentations 47 in the bottom of groove 46 and the teeth 49 on the edge of the flange 48, can also be accomplished by means of cooperating transverse ripples on the bottom of the adjusting body facing the web surface 16, on the one hand, and matching transverse ripples on the web surface of the guide rail 12 on the other, and both forms of these security measures can be provided alternatively or together. A securing of the adjusting body 36 against unintentional separation from the guide rail 12 can additionally or alternatively be provided by a narrowing of the open mouth of the slot 38, because then a complete removal of the adjusting body 36 can be accomplished only by an intentional elastic expansion of the mouth of the slot 38 by the pivot pin 24.

I claim:

1. A guide for a drawable cabinet part, comprising: an elongated guide rail for fastening to a cabinet carcase, and having a front end and a rear end, and a flange; an elongated runner rail for fastening to a drawable cabinet part, and having a front end and a rear end, and also having a flange; said guide rail having a vertical web surface facing the runner rail, said rails being displaceable relative to one another on first roller means rotatably mounted on the front end of the guide rail and rolling on the flange of the runner rail, and second roller means rotatably mounted on the rear end of the runner rail, and rolling on the flange of the guide rail, an an adjustable adjusting element engaging the runner rail and disposed on the guide rail for adjusting transverse free play of the drawable cabinet part, said adjusting element being mounted removably on the vertical web surface on the front end of the guide rail, and displaceable at right angles to the length of the guide rail, said adjusting element having a ramp surface slanting in the direction of displacement and facing the flange of the runner rail rolling on the first roller means.

2. A guide according to claim 1, wherein said adjusting element is disposed in an interstice between said web surface and the first roller means on a pivot projecting from said web surface.

3. A guide according to claim 2, wherein said adjusting element is a disk in said interstice, and has a slot extending in the direction of displacement and having an open end accomodating the pivot.

4. A guide according to claim 3, wherein the adjusting element has a portion projecting from the interstice toward the front end of the guide rail, and a thumb hold on said projecting portion for facilitating displacement of the adjusting element.

5. A guide according to claim 2, wherein the adjusting element has a portion projecting from the interstice toward the front end of the guide rail, and a thumb hold on said projecting portion for facilitating displacement of the adjusting element.

6. A guide according to claim 3, comprising a plurality of abutments, at least one of said abutments being on the adjusting element, and at least one other abutment being on the guide rail, said one and said other abutment coming into contact with one another upon displacement of the adjusting element before the pivot emerges from the open end of the slot.

7. A guide according to claim 6, wherein said at least one other abutment on the guide rail is a horizontal transverse edge of an unbent section of the edge area, and the at least one abutment on the adjusting element is a projection extending from a bottom of the element and facing the web surface.

8. A guide according to claim 1, wherein the adjusting element has a groove facing the web surface, said groove running in the direction of displacement, said guide rail having a portion projecting into said groove.

9. A guide according to claim 8, comprising first catch indentations in the bottom of the groove, said first indentations running transversely in uniform pitch, and complementary second catch projections on the free edge of said portion for meshing with the first indentations.

10. A guide according to claim 1, wherein said adjusting element projects to approximately a front vertical edge area of the guide rail, a narrow section of the edge area extending over only a portion of the height of the front edge and being bent to form the portion engaging the groove.

11. A guide according to claim 1, wherein the adjusting element is a thermoplastic, injection molded piece.

* * * * *